US006804484B2

(12) United States Patent
Hashimoto et al.

(10) Patent No.: US 6,804,484 B2
(45) Date of Patent: Oct. 12, 2004

(54) TONER CARTRIDGE AND ELECTROPHOTOGRAPHIC APPARATUS ADOPTING THE SAME

(75) Inventors: Toshifumi Hashimoto, Yokohama (JP); Takashi Ando, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 50 days.

(21) Appl. No.: 10/244,590

(22) Filed: Sep. 17, 2002

(65) Prior Publication Data

US 2003/0068174 A1 Apr. 10, 2003

(30) Foreign Application Priority Data

Sep. 17, 2001 (JP) ..... 2001-282431

(51) Int. Cl.[7] ..... G03G 15/08

(52) U.S. Cl. ..... 399/120; 222/DIG. 1; 399/262

(58) Field of Search ..... 222/DIG. 1; 399/119, 399/120, 123, 262, 263, 343, 358, 359, 360

(56) References Cited

U.S. PATENT DOCUMENTS 5,479,247 A * 12/1995 Watanabe et al. ..... 399/120

FOREIGN PATENT DOCUMENTS

JP 3217879 9/1991

* cited by examiner

*Primary Examiner*—Hoang Ngo
(74) *Attorney, Agent, or Firm*—Staas & Halsey LLP

(57) ABSTRACT

A toner cartridge is detachably loaded in a predetermined loading portion of an electrophotographic apparatus and has a new toner containing space where new toner is contained, and a waste toner containing space where waste toner is contained. The toner cartridge includes a main body, a supply hole supplying the new toner and a receiving hole for receiving waste toner, which are installed at a predetermined position of the main body of the toner cartridge, and an open and shut mechanism having a single shutter opening and shutting the supply hole and the receiving hole. The electrophotographic apparatus for forming an image on a recording medium includes the loading portion where the toner cartridge is detachably installed, and the toner cartridge.

43 Claims, 7 Drawing Sheets

TONER CARTRIDGE AND ELECTROPHOTOGRAPHIC APPARATUS ADOPTING THE SAME

CROSS-REFERENCE TO RELATED APPLICATIONS

This application claims the benefit of Japanese Application No. 2001-282431, filed Sep. 17, 2001, in the Japanese Patent Office, the disclosure of which is incorporated herein by reference.

BACKGROUND OF THE INVENTION

1. Field of the Invention

The present invention relates to a toner cartridge and an electrophotographic apparatus adopting the same, and more particularly, to a toner cartridge in which a structure to supply new toner and a structure to contain waste toner are improved, and an electrophotographic apparatus adopting the same 2. Description of the Related Art In general, an electrophotographic apparatus forms an image on a recording medium by attaching toner powder to a surface of an object, such as a photoreceptor where an electrostatic latent image is formed, and transferring the toner powder from the surface of the object to the recording medium. Also, unnecessary toner attached to the surface of the object is collected as waste toner.

Typically, as a method of supplying toner to the electrophotographic apparatus, there are a method of directly supplying toner from an outside of the electrophotographic apparatus and a method of replacing a toner cartridge by removing an old toner cartridge from a main body of the electrophotographic apparatus and installing a new one in the electrophotographic apparatus.

FIGS. 1A through 1C show a conventional toner cartridge used in a cartridge replacement type electrophotographic apparatus. Referring to FIG. 1A, a toner cartridge 70 has a new toner containing portion 71 as a space for containing new toner and a waste toner containing portion 72 as a space for containing waste toner. A supply hole 73 through which the new toner is supplied to an outside of the toner cartridge 70 is installed in the new toner containing portion 71. A receiving hole 74 through which the waste toner is received from the outside of the toner cartridge 70 is installed in the waste toner containing portion 72.

Also, open/shut mechanisms 75 and 76 are installed at the supply hole 73 and the receiving hole 74, respectively, in order to prevent contamination by the toner during replacement of the toner cartridge 70. FIG. 1B shows the open/shut mechanism 75 installed at the supply hole 73. FIG. 1C shows the open/shut mechanism 76 installed at the receiving hole 74.

For example, the open/shut mechanism 75 of FIG. 1B opens and shuts the supply hole 73 by moving a shutter member 77 in a circumferential direction of a plane of the open/shut mechanism 75. The open/shut mechanism 76 of FIG. 1C opens and shuts the receiving hole 74 by moving a shutter member 79 connected to a metal spring member 78 to slide linearly along a plane of the open/shut mechanism 76.

The conventional apparatus having the above structure has a complicated structure so that a manufacturing cost increases, and replacement of the toner cartridge becomes inconvenient and difficult. Accordingly, the toner cartridge and the electrographic apparatus which are cheap and provide convenience in replacement are needed.

SUMMARY OF THE INVENTION

To solve the above and other problems, it is an object of the present invention to provide a toner cartridge which is cheap and easy to be replaced, and an electrophotographic apparatus adopting the same.

To achieve an aspect of the invention, there is provided a toner cartridge which is detachably loaded in a predetermined loading portion and has a new toner containing space where new toner is contained, and a waste toner containing space where waste toner is contained, the toner cartridge comprising a supply hole supplying the new toner to an outside of the toner cartridge and a receiving hole receiving the waste toner from the outside of the toner cartridge, which are installed in a predetermined position of a main body of the toner cartridge. The toner cartridge further comprises an open and shut mechanism opening and shutting the supply hole and the receiving hole using a single shutter.

It is possible in the present invention that the open and shut mechanism opens and shuts the supply hole and the receiving hole by operating the shutter in response to an engagement with the loading portion during installation and detaching operations with respect to the loading portion, and that the open and shut mechanism comprises a driven portion installed on the shutter and a guide groove formed in the loading portion so that the driven portion moves along the guide groove when the toner cartridge is installed in or detached from the loading portion, to guide a movement of the shutter through the driven portion.

It is possible in the present invention that all elements constituting the open and shut mechanism are formed of resin.

It is possible in the present invention that the toner cartridge further comprises at least one of a first transfer unit transferring the new toner from the new toner containing space to the supply hole and a second transfer unit transferring the waste toner from the receiving hole to the waste toner containing space.

To achieve another aspect of the present invention, there is provided an electrophotographic apparatus for forming an image on a recording medium by attaching toner to a photoreceptive body where an electrostatic latent image is formed, and transferring the toner to the recording medium from the photoreceptive body. The electrophotographic apparatus comprises a loading portion where the toner cartridge is detachably installed, wherein the toner cartridge comprises a new toner containing space where new toner is contained, a waste toner containing space where waste toner is contained, a supply hole supplying new toner to an outside of the toner cartridge and a receiving hole receiving waste toner from the outside of the toner cartridge, which are installed in a predetermined position of a main body of the toner cartridge, and an open and shut mechanism opening and shutting the supply hole and the receiving hole using a single shutter.

BRIEF DESCRIPTION OF THE DRAWINGS

The above object and advantages of the present invention will become more apparent and understood by describing in detail preferred embodiments thereof with reference to the attached drawings in which.

DETAILED DESCRIPTION OF THE INVENTION

Figure 1A:
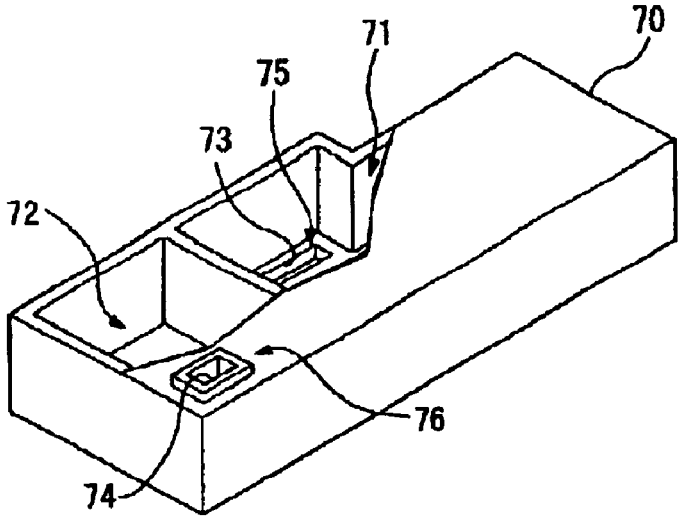
FIG. 1A (PRIOR ART)
FIG. 1A is a perspective view illustrating a conventional toner cartridge used in an electrophotographic apparatus.
Figure 1B:
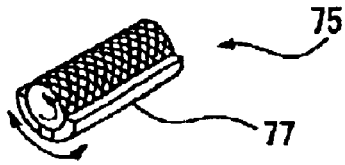
FIG. 1B (PRIOR ART)
FIGS. 1B and 1C are perspective views illustrating an open/shut mechanism of the toner cartridge shown in FIG. 1A.
Figure 1C:
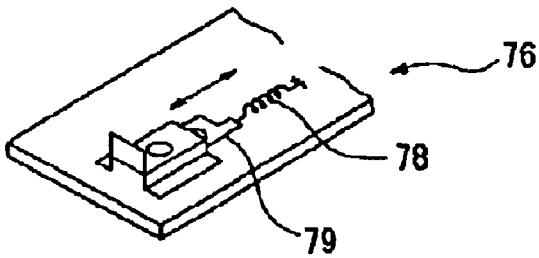
FIG. 1C (PRIOR ART)
Figure 2:
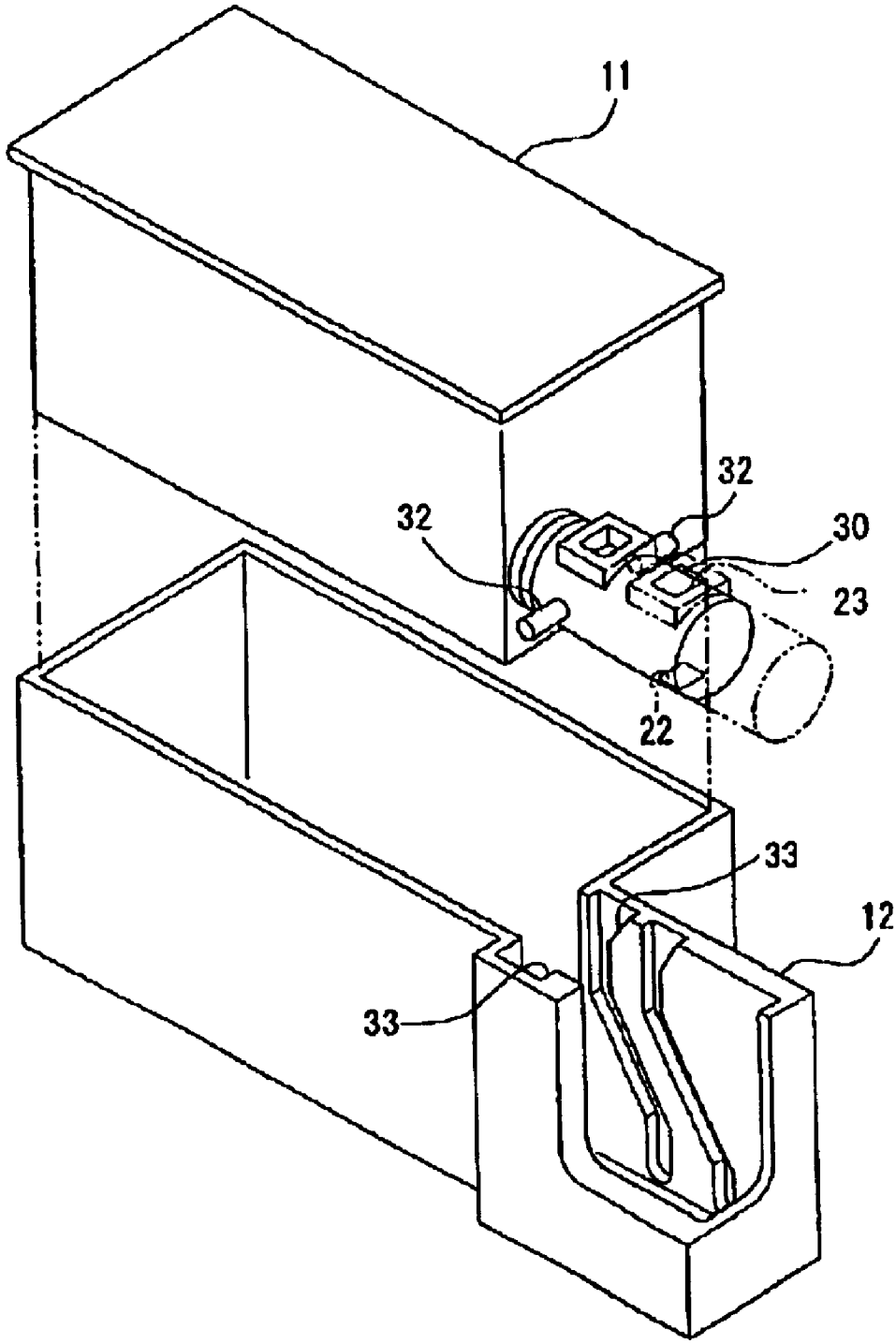
FIG. 2 is a perspective view illustrating a toner cartridge according to an embodiment of the present invention.
Figure 3:
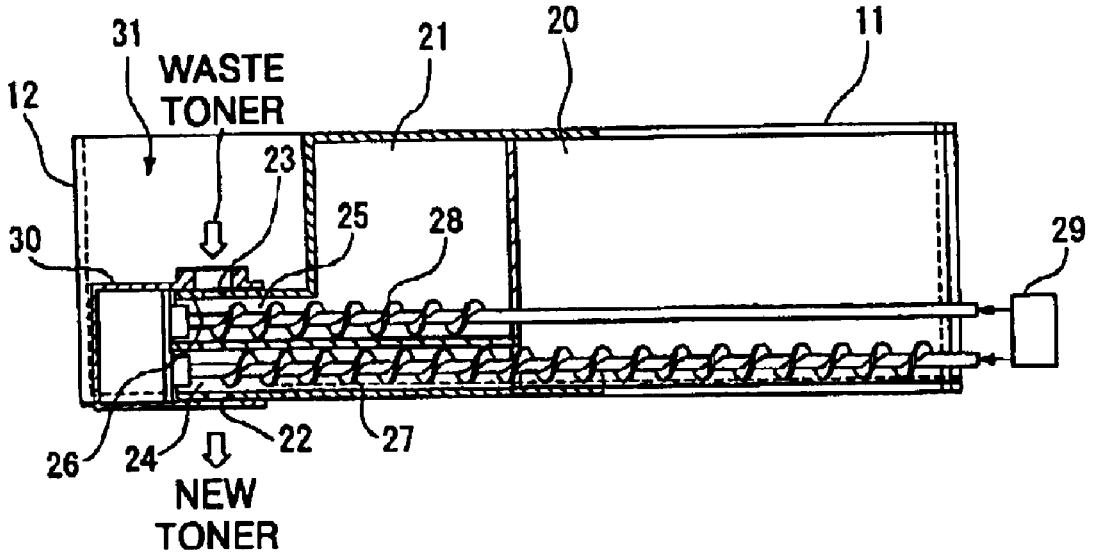
FIG. 3 is a sectional view illustrating the toner cartridge of FIG. 2.

Referring to FIGS. 2 and 3, a toner cartridge 11 according to an embodiment of the present invention is detachably loaded in a loading portion 12 installed in an electrophotographic apparatus. The loading portion 12 has a box shape with one open side through which the toner cartridge 11 is detachably loaded in the loading portion 12.

The toner cartridge 11 includes a new toner containing portion 20 that is a space for containing new toner powder and a waste toner containing portion 21 that is a space for containing unnecessary waste toner collected from the electrophotographic apparatus. Also, the toner cartridge 11 has a supply hole 22 through which the new toner is supplied to an outside of the toner cartridge 11, that is, an outside of the loading portion 12 of the electrophotographic apparatus, and a receiving hole 23 through which the waste toner is received. The supply hole 22 is connected to the new toner containing portion 20 via a supply path 24. The receiving hole 23 is connected to the waste toner containing portion 21 via a receiving path 25.

To make structures for the loading portion 12 of the electrophotographic apparatus and the toner cartridge 11 compact, the supply hole 22 and the receiving hole 23 may be disposed adjacent to each other. For this, the toner cartridge 11 includes an input/output portion 26 that is cylindrical and protrudes from a surface of the toner cartridge 11. The supply hole 22 and the receiving hole 23 are installed at predetermined positions on a surface of the cylindrical input/output portion 26. An inner space of the input/output portion 26 are divided into two paths, that is, the supply path 24 and the receiving path 25. The supply path 24 connects the supply hole 22 and the new toner containing portion 20. The supply path 24 connects the receiving hole 23 and the waste toner containing portion 21. Here, a shape of the input/output portion 26 is not limited to a cylinder and any shapes can be adopted.

Also, the toner cartridge 11 includes a transfer unit transferring the new toner and the waste toner. The transfer unit is connected to a driving portion 29 installed on the loading portion 12 and includes first and second screws 27 and 28 carrying the new toner and the waste toner by rotation, respectively.

The first screw 27 is disposed to rotate in the supply path 24 and the new toner containing portion 20 and transfers the new toner toward the supply hole 22 from the new toner containing portion 20. The second screw 28 is disposed to rotate in the receiving path 25 and the waste toner containing portion 21 and transfers the waste toner toward the waste toner containing portion 21 from the receiving hole 23.

As described above, the new toner and the waste toner are easily transferred to the supply hole 22 from the new toner containing portion 20 and to the waste toner containing portion 21 from the receiving hole 23 by the transfer unit, respectively. The input/output portion 26 is provided so that the supply hole 22 and the receiving hole 23 are disposed in one place of the toner cartridge 11. Thus, the toner cartridge 11 can be made compact.

Also, the toner cartridge 11 has an open/shut portion 31 opening/shutting the supply hole 22 and the receiving hole 23. The open/shut portion 31 opens the supply hole 22 and the receiving hole 23 when the toner cartridge 11 is installed in the loading portion 12 and shuts the supply hole 22 and the receiving hole 23 when the toner cartridge 11 is detached from the loading portion 12.

Referring to FIGS. 4A through 4D, the open/shut portion 31 includes a shutter 30, a first driven portion 32 installed on an outer surface of the shutter 30 to form a coupling portion with the loading portion 12, a guide groove 33 formed on an inner surface of the loading portion 12, and a locking mechanism 34 locking a movement of the shutter 30 with respect to a main body of the toner cartridge 11. Also, the first driven portion 32 and the guide groove 33 are installed on opposite (facing) surfaces of the shutter 30 and the loading portion 12, respectively.

The shutter 30 has a shape corresponding to the input/output portion 26, for example, a cylindrical shape having one side open and other sides closed. The shutter 30 is slidably inserted around the input/output portion 26 in an axial direction of the input/output portion 26. Openings 50 and 51 are formed on respective positions of the shutter 30 corresponding to the supply hole 22 and the receiving hole 23, respectively.

In the open/shut portion 31 having the above structure, the first driven portion 32 moves along the guide groove 33 when the toner cartridge 11 is installed in or detached from the loading portion 12. Here, the guide groove 33 guides the shutter 30 moving in the axial direction of the input/output portion 26 by the first driven portion 32 when the toner cartridge 11 is installed in or detached from the loading portion 12.

The locking mechanism 34 includes a hooking step 40 installed on the main body of the toner cartridge 11, a locking arm 42 installed on the shutter 30 to rotate around a pivot shaft 41, a guide groove 44 installed in the loading portion 12, and a second driven portion 43 formed on the locking arm 42, protruding from the locking arm 42, and moving along the guide groove 44 to move the locking arm 42 with respect to the hooking step 40 and the shutter 30.

The locking arm 42 is formed of resin, such as polyacetal, and part (an elastic portion 45) of the locking arm 42 is formed as a thin plate to function as an elastic body. One end of the elastic portion 45 contacts a protrusion 46 installed on the shutter 30 and is bent according to a change of an installation angle of the locking arm 42 with respect to the pivot shaft 41. As the second driven portion 43 moves along the guide groove 44, the installation angle of the locking arm 42 changes. Also, as a hook 42*a* of the locking arm 42 is caught by the hooking step 40, the shutter 30 stops moving in the axial direction. When the hook 42*a* is released from the hooking step 40, the shutter 30 can move in the axial direction.

In the present preferred embodiment, the locking mechanism 34 locks the shutter 30 not to move with respect to the input/output portion 26 of the toner cartridge 11 when the toner cartridge 11 is detached from the loading portion 12, and releases the shutter 30 to move with respect to the input/output portion 26 of the toner cartridge 11 at an initial stage when the toner cartridge 11 is loaded in the loading portion 12.

Next, an installation operation of the open/shut portion 31 when the toner cartridge 11 is loaded in the loading portion 12 will now be described with reference to FIGS. 4A through 4D.

Figure 4A:
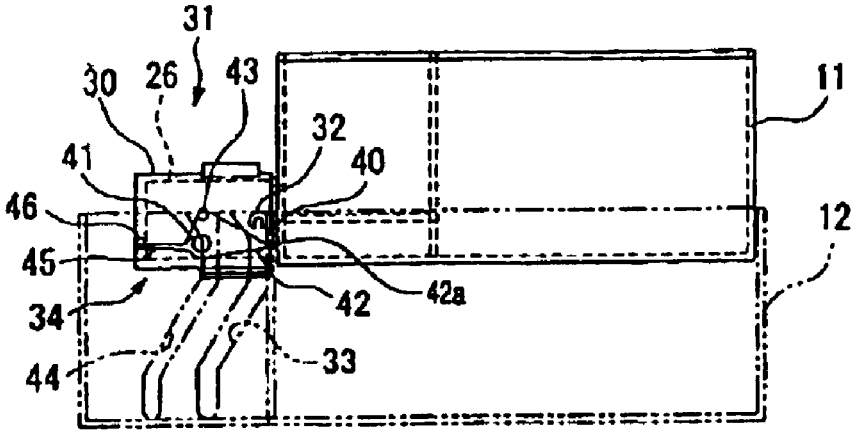
FIGS. 4A through 4D are views explaining a structure and an operation of an open/shut portion of the toner cartridge of FIG. 2.

FIG. 4A shows each state of the toner cartridge 11 and the loading portion 12 before the toner cartridge 11 is loaded in the loading portion 12. Here, the shutter 30 is disposed at a locked position in which the shutter 30 is disposed most close to the main body of the toner cartridge 11. Since the hook 42*a* is caught by the hooking step 40, the shutter 30 cannot move in the axial direction of the shutter 30.

Figure 4B:
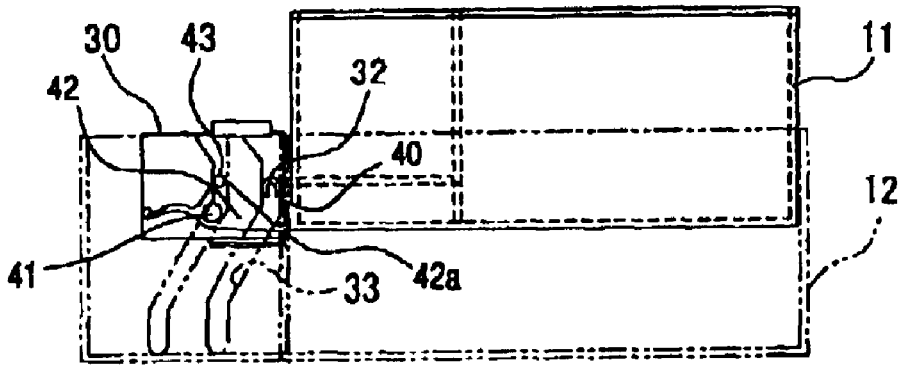

FIG. 4B shows an initial operation in which the toner cartridge 11 is loaded in the loading portion 12. As the second driven portion 43 is guided along the guide groove 44, the locking arm 42 rotates around the pivot shaft 41 so that the installation angle changes. Thus, the hook 42*a* is separated from the hook step 40 to so that the shutter 30 is unlocked to be in an unlocked position in which the shutter freely moves with respect to the toner cartridge 11.

Figure 4C:
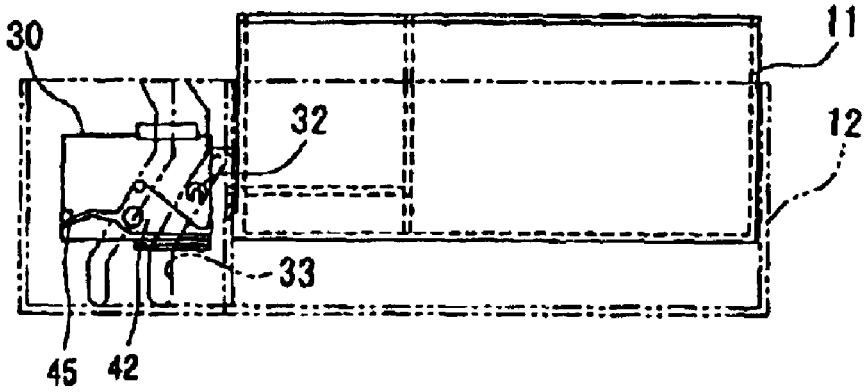

FIG. 4C shows an intermediate operation in which the toner cartridge 11 is being loaded in the loading portion 12. The first driven portion 32 installed on the shutter 30 is moved in the axial direction of the shutter 30 along the guide groove 33 installed in the loading portion 12. Accordingly, the shutter 30 that is unlocked moves in a direction away from the main body of the toner cartridge 11. Here, the elastic portion 45 of the locking arm 42 is bent to a bent state from an original state.

Figure 4D:
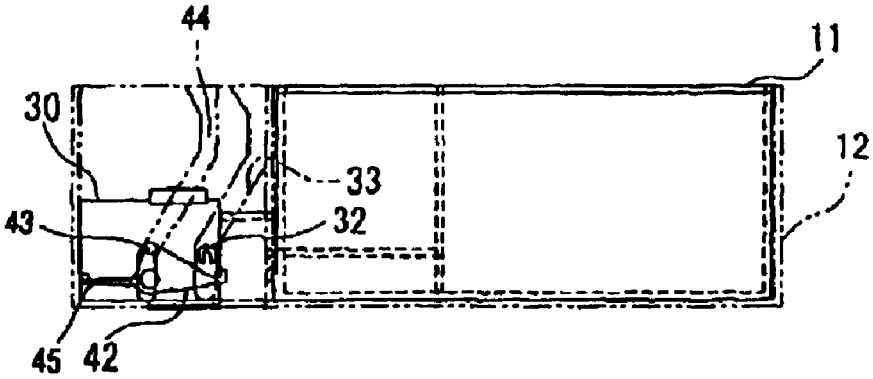

FIG. 4D shows a loading operation in which the toner cartridge 11 is completely loaded in the loading portion 12. The shutter 30 is arranged at an away position far away from the main body of the toner cartridge 11. Here, a position of the second driven portion 43 moved by being guided by the guide groove 44 is changed with respect to the shutter 30. The elastic portion 45 of the locking arm 42 is returned from the bent state to the original state.

As described above, the open/shut portion 31 is operated in the above described order during the installation operation when the toner cartridge 11 is installed at the loading portion 12. That is, the shutter 30 is moved in a direction to be separated from the main body of the toner cartridge 11. To the contrary, when the toner cartridge 11 is detached from the loading portion 12, the open/shut portion 31 operates in a reversed order, and the shutter 30 is locked by the locking mechanism 34 before being detached.

Figure 5A:
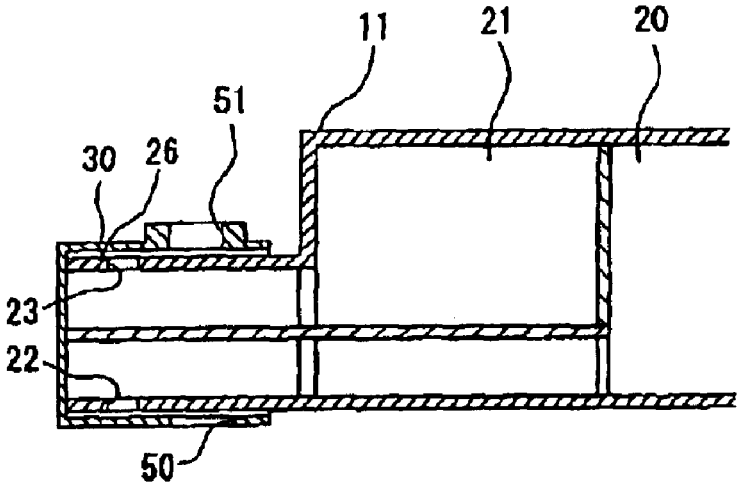
FIGS. 5A and 5B are sectional views illustrating detached and loaded states of the toner cartridge of FIG. 2.
Figure 5B:
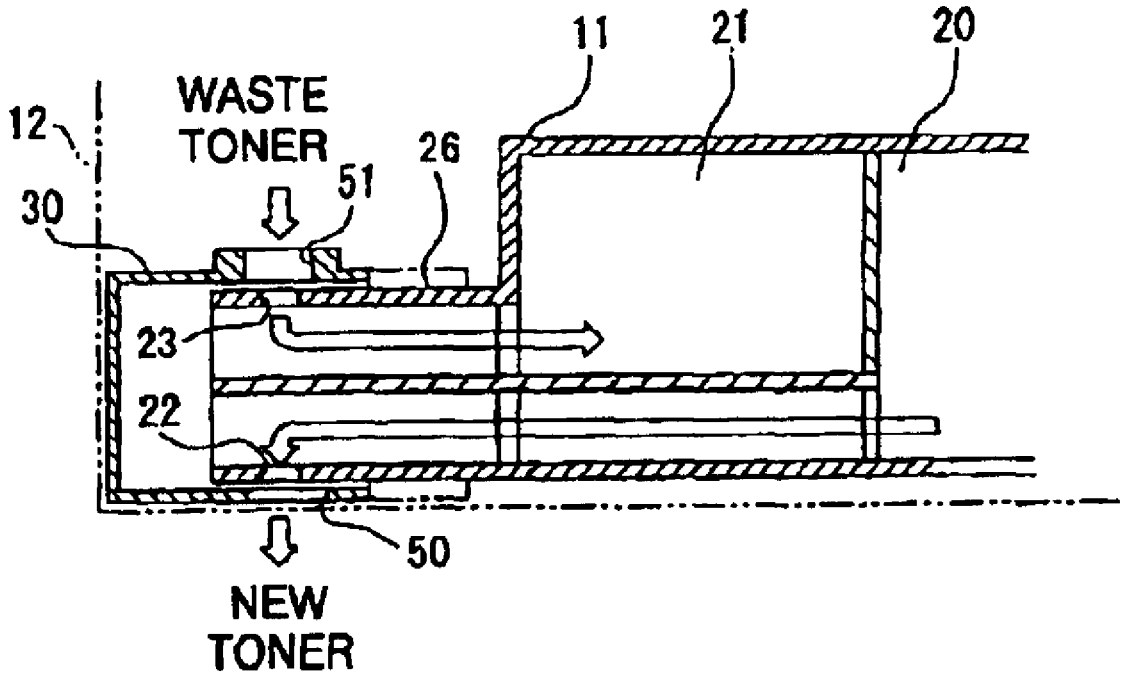

FIG. 5A shows a first state of the toner cartridge 11 in which the toner cartridge 11 is detached from the loading portion 12. FIG. 5B shows a second state of the toner cartridge 11 in which the toner cartridge 11 is loaded in the loading portion 12.

Referring to FIG. 5A, when the toner cartridge 11 is detached from the loading portion 12, the shutter 30 is disposed in the locked position in which the shutter 30 is disposed most close to the main body of the toner cartridge 11. In this case, the positions of the openings 50 and 51 of the shutter 30, and the supply hole 22 and the receiving hole 23 of the toner cartridge 11, are deviated from each other in the axial direction. Thus, the supply hole 22 and the receiving hole 23 are in a shut state.

Referring to FIG. 5B, when the toner cartridge 11 is loaded in the loading portion 12, the shutter 30 is disposed in the unblocked position in which is the shutter 30 is disposed most away from the main body of the toner cartridge 11. In this case, the positions of the openings 50 and 51 of the shutter 30, and the supply hole 22 and the receiving hole 23 of the toner cartridge 11, match each other in the axial direction. Thus, the supply hole 22 and the receiving hole 23 are open.

When the supply hole 22 is open, the new toner is transferred from the new toner containing portion 20 toward the supply hole 22, through the first screw 27 shown in FIG. 3, and then the new toner is supplied to the outside of the toner cartridge 11, that is, to the electrophotographic apparatus through the supply hole 22 and the opening 50.

Also, when the receiving hole 23 is open, the waste toner comes in the toner cartridge 11 along the receiving path 25 through the opening 51 and the receiving hole 23, and is transferred toward the waste toner containing portion 21 by the second screw 28 shown in FIG. 3.

The toner cartridge 11 having the above structure operates the shutter 30 to open/shut the supply hole 22 and the receiving hole 21 by performing installing/detaching operations with respect to the loading portion 12. Thus, additional work to open/shut the supply hole 22 and the receiving hole 23 is not necessary during an exchange operation of the toner cartridge 11, so that work productivity can be improved.

Also, since the supply hole 22 and the receiving hole 23 are open and shut by the single shutter 30, the number of parts can be reduced, and a manufacturing cost can be reduced compared to conventional technology and toner cartridge.

Also, every constituent element including the locking arm 42 of the toner cartridge 11 according to the present invention may be formed of resin. Thus, the toner cartridge 11 that is used up can be easily disposed of.

Figure 6:
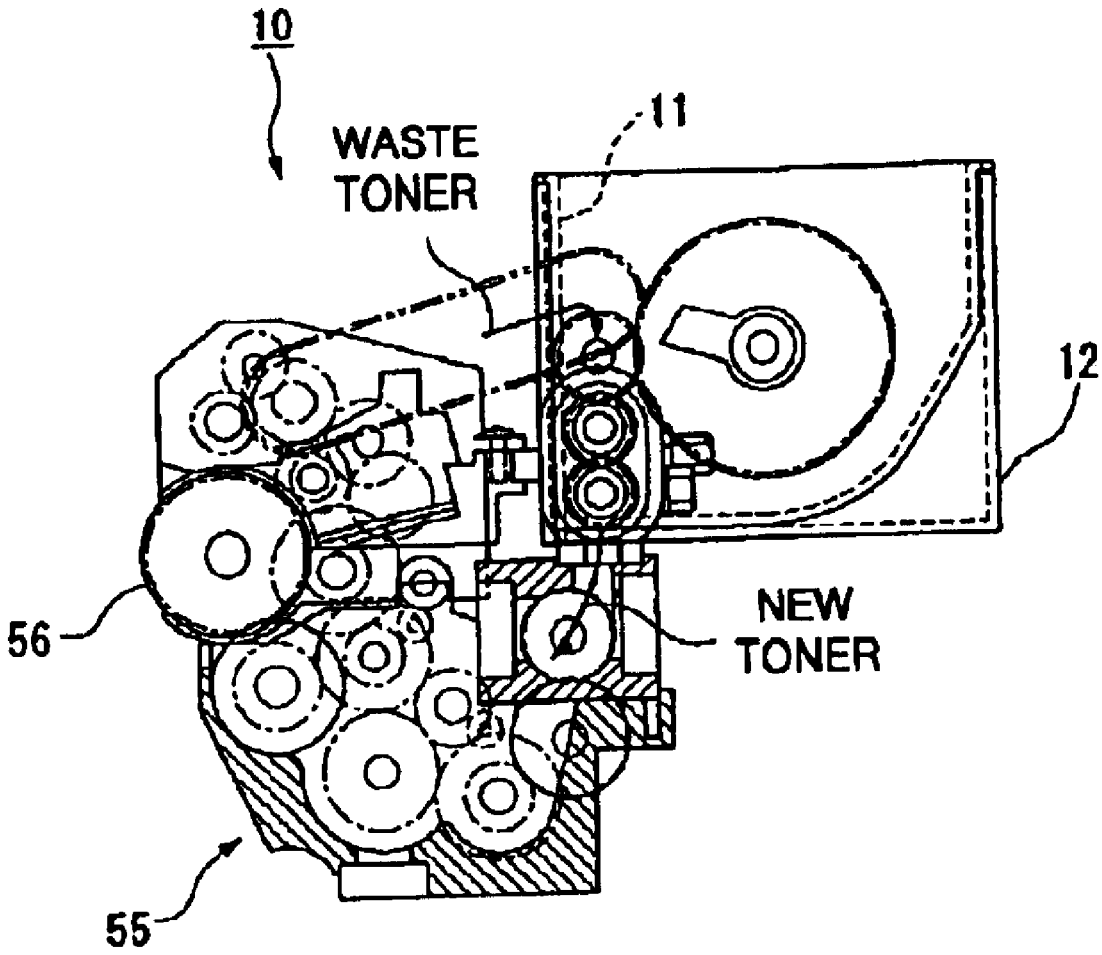
FIG. 6 is a sectional view illustrating an electrophotographic apparatus adopting the toner cartridge of FIG. 2 according to another embodiment of the present invention.

FIG. 6 shows an electrophotographic apparatus according to another embodiment of the present invention. The electrophotographic apparatus 10 adopts the toner cartridge 11 with reference to FIGS. 2 through 5.

Referring to FIG. 6, the toner cartridge 11 is detachably loaded in the loading portion 12 installed in a main body of the electrophotographic apparatus. Also, new toner supplied from the toner cartridge 11 adheres to a photoreceptive drum 56 installed in a process unit 55 having a plurality of rollers. Also, a transfer roller, a cleaner removing remaining toner, a charging roller, and a laser scanning unit recording an electrostatic latent image on a surface of the photoreceptive drum 56 charged to a predetermined electric potential by the charging roller, which are not shown, are installed in the process unit 55. When the new toner adheres to the surface of the photoreceptive drum 56 where the electrostatic latent image is formed, print paper passes between the photoreceptive drum 56 and the transfer roller. Accordingly, the new toner is transferred to the print paper so that a text or an image is formed on the print paper. Also, after the new toner is transferred from the photoreceptive drum 56 to the print paper, unnecessary toner adhering to the surface of the photoreceptive drum 56 is removed by the cleaner and collected in the toner cartridge 11 as waste toner.

As described above, in the toner cartridge according to the present invention and the electrophotographic apparatus adopting the toner cartridge, the new toner supply hole and the waste toner receiving hole are installed in a predetermined portion of the toner cartridge and are open/shut by the single shutter. Thus, a low manufacturing cost is possible, and the toner cartridge can be easily replaced.

While this invention has been particularly shown and described with reference to preferred embodiments thereof, it will be understood by those skilled in the art that various changes in form and details may be made therein without departing from the spirit and scope of the invention as defined by the appended claims and their equivalents.

What is claimed is:

1. A toner cartridge which is detachably loaded in a predetermined loading portion of an image forming apparatus and has a main body including a new toner containing space where new toner is contained, and a waste toner containing space where waste toner is contained, the toner cartridge comprising:

a supply hole through which the new toner is supplied from the new toner containing space to an outside of the main body;

a receiving hole through which the waste toner is received from the outside of the main body into the waste toner containing space, the supply hole and the receiving hole formed at a predetermined position of the main body; and an open and shut mechanism having a single shutter opening and shutting the supply hole and the receiving hole when the toner cartridge is loaded in and detached from the loading portion.

2. The toner cartridge as claimed in claim 1, further comprising:

one of a first transfer unit transferring the new toner from the new toner containing space to the supply hole and a second transfer unit transferring the waste toner from the receiving hole to the waste toner containing space.

3. The toner cartridge as claimed in claim 1, wherein the shutter of the open and shut mechanism opens and shuts the supply hole and the receiving hole when the shutter is engaged with and disengaged from the loading portion during installation and detaching operations of the main body with respect to the loading portion.

4. The toner cartridge as claimed in claim 3, wherein the open and shut mechanism comprises:

a driven portion installed on the shutter; and a guide groove formed in the loading portion so that the driven portion moves along the guide groove when the toner cartridge is installed in or detached from the loading portion, to guide a movement of the shutter.

5. The toner cartridge as claimed in claim 3, further comprising:

one of a first transfer unit transferring the new toner from the new toner containing space to the supply hole and a second transfer unit transferring the waste toner from the receiving hole to the waste toner containing space.

6. The toner cartridge as claimed in claim 1, wherein the open and shut mechanism is formed of resin.

7. An image forming apparatus for forming an image on a recording medium by attaching toner to a photoreceptive body where an electrostatic latent image is formed, and transferring the toner to the recording medium from the photoreceptive body, the electrophotographic apparatus comprising:

a loading portion; and a toner cartridge detachably installed in the loading portion, wherein the toner cartridge comprises:

a main body, a new toner containing space formed in the main body to contain new toner, a waste toner containing space formed in the main body to contain waste toner, a supply hole supplying the new toner to an outside of the main body from the new toner containing space, and formed in a predetermined position of the main body, a receiving hole receiving the waste toner from the outside of the main body into the waste toner containing space, and formed in the predetermined position of the main body, and an open and shut mechanism having a single shutter opening and shutting the supply hole and the receiving hole.

8. The apparatus as claimed in claim 7, wherein the toner cartridge comprises:

one of a first transfer unit transferring the new toner from the new toner containing space to the supply hole and a second transfer unit transferring the waste toner from the receiving hole to the waste toner containing space.

9. The apparatus as claimed in claim 7, wherein the shutter of the open and shut mechanism opens and shuts the supply hole and the receiving hole when the shutter is engaged with and disengaged from the loading portion during installation and detaching operations with respect to the loading portion, and the open and shut mechanism comprises:

a driven portion installed on the shutter; and a guide groove formed in the loading portion so that the driven portion moves along the guide groove when the toner cartridge is installed in or detached from the loading portion, to guide a movement of the shutter.

10. The apparatus as claimed in claim 9, where the toner cartridge further comprises:

one of a first transfer unit transferring the new toner from the new toner containing space to the supply hole and a second-transfer unit transferring the waste toner from the receiving hole to the waste toner containing space.

11. A toner cartridge which is detachably loaded in a loading portion of an image forming apparatus and has a main body including a new toner containing space portion where new toner is contained, and a waste toner containing space portion where waste toner is contained, the toner cartridge comprising:

a supply hole formed on the main body, and through which the new toner is supplied from the new toner containing space portion to an outside of the main body;

a receiving hole formed on the main body, and through which the waste toner is received from the outside of the main body into the waste toner containing space portion; and an open and shut mechanism having a single shutter automatically opening and shutting the supply hole and the receiving hole when the toner cartridge is loaded in and detached from the loading portion.

12. The toner cartridge as claimed in claim 11, wherein the main body comprises an input/output portion formed on a portion of the main body and having a supply path portion disposed between the supply hole and the new toner containing space portion and a receiving path portion disposed between the receiving hole and the waste toner containing space portion, and the supply hole and the receiving hole are formed on the input/output portion.

13. The toner cartridge as claimed in claim 12, wherein the input/output portion protrudes from a surface of the main body.

14. The toner cartridge as claimed in claim 12, wherein the input/output portion comprises an inside space divided into the supply path portion and the receiving path portion in an axial direction of the input/output portion.

15. The toner cartridge as claimed in claim 12, wherein the input/output portion comprises two opposite surfaces defining the supply path portion and the receiving path portion, respectively, and the supply hole and the receiving hole are formed on corresponding ones of the two opposite surfaces of the input/output portion.

16. The toner cartridge as claimed in claim 12, wherein the new toner containing space portion and the supply path portion are disposed along an axial direction of the input/output portion, and the waste toner containing space portion and the receiving path portion are disposed along the axial direction of the input/output portion.

17. The toner cartridge as claimed in claim 12, wherein the open/shut mechanism comprises:

an open/shut portion including the shutter having openings corresponding to the supply hole and the receiving hole.

18. The toner cartridge as claimed in claim 17, wherein the openings are disposed in a first position in an axial direction of the input/output portion, and the supply hole and the receiving hole are disposed in a second position in the axial direction of the input/output portion.

19. The toner cartridge as claimed in claim 18, wherein the openings move from the first position to the second position to open the supply hole and the receiving hole when the main body is loaded in the loading portion.

20. The toner cartridge as claimed in claim 18, wherein the openings move from the second position to the first position to shut the supply hole and the receiving hole when the main body is detached from the loading portion.

21. The toner cartridge as claimed in claim 17, wherein the open/shut portion comprises a corresponding shape to the input/output portion and is slidably inserted around the input/output portion.

22. The toner cartridge as claimed in claim 17, wherein the shutter of the open/shut portion moves in an axial direction of the input/output portion when the toner cartridge is loaded in and detached from the loading portion.

23. The toner cartridge as claimed in claim 17, wherein the shutter of the open/shut portion moves in an axial direction of the input/output portion when the toner cartridge is loaded in and detached from the loading portion in a direction perpendicular to the axial direction.

24. The toner cartridge as claimed in claim 17, wherein the open/shut portion comprises:

a driven portion formed on the shutter; and a guide groove formed on the loading portion to guide the driven portion of the shutter when the toner cartridge is loaded in and detached from the loading portion.

25. The toner cartridge as claimed in claim 24, wherein the driven portion is disposed between the supply hole and the receiving hole.

26. The toner cartridge as claimed in claim 24, wherein the guide groove is obliquely formed with respect to an axial direction in which the shutter moves.

27. The toner cartridge as claimed in claim 24, wherein the guide groove guides the driven portion in an axial direction of the shutter of the open/shut portion so that the openings communicate with the supply hole and the receiving hole, respectively.

28. The toner cartridge as claimed in claim 17, wherein the shutter of the open/shut portion comprises a hollow cylindrical shape, and the openings are formed on opposite positions of a circumferential surface of the shutter.

29. The toner cartridge as claimed in claim 17, wherein the open/shut mechanism comprises:

a locking mechanism controlling the shutter not to move and to move with respect to the input/output portion.

30. The toner cartridge as claimed in claim 29, wherein the locking mechanism comprises:

a locking arm having a pivot shaft to be coupled to one of the main body and the input/output portion.

31. The toner cartridge as claimed in claim 30, wherein the pivot shaft is fixedly coupled to the shutter of the open/shut portion.

32. The toner cartridge as claimed in claim 30, wherein the locking mechanism comprises:

a hooking step formed one of the main body and the input/output portion to be coupled to the locking arm.

33. The toner cartridge as claimed in claim 32, wherein the locking arm comprises:

a hook formed on an end of the locking arm to be caught by the hooking step and released from the hooking step.

34. The toner cartridge as claimed in claim 32, wherein the locking mechanism comprises:

a driven portion formed on the locking arm; and a guide groove formed on the loading portion to guide the driven portion so that the locking arm is locked on and unlocked from the hooking step.

35. The toner cartridge as claimed in claim 34, wherein the guide groove is obliquely formed with respect to an axial direction in which the shutter moves.

36. The toner cartridge as claimed in claim 34, wherein the guide groove guides the driven portion to rotate the locking arm about the pivot shaft.

37. The toner cartridge as claimed in claim 30, wherein the locking arm is made of resin.

38. The toner cartridge as claimed in claim 11, further comprising:

a transfer unit transferring the new toner from the new toner containing space portion to the supply hole and the waste toner from the receiving hole to the waste toner containing space portion.

39. The toner cartridge as claimed in claim 38, wherein the transfer unit comprises:

a first screw rotatably disposed in the new toner containing space portion; and a second screw rotatably disposed in the waste toner containing space portion.

40. The toner cartridge as claimed in claim 39, wherein the first screw and the second screw are parallel to each other.

41. The toner cartridge as claimed in claim 38, wherein the transfer unit comprises:

a driving portion mounted on the loading portion to rotate the first screw and the second screw.

42. The toner cartridge as claimed in claim 41, wherein the first screw and the second screw are connected to the driving portion when the toner cartridge is loaded in the loading portion, and disconnected from the driving portion when the toner cartridge is detached from the loading portion.

43. A toner cartridge which is detachably loaded in a loading portion of an image forming apparatus and has a main body including a new toner containing space portion where new toner is contained, and a waste toner containing space portion where waste toner is contained, the toner cartridge comprising:

a supply hole formed on the main body, and through which the new toner is supplied from the new toner containing space portion to an outside of the main body;

a receiving hole formed on the main body, and through which the waste toner is received from the outside of the main body into the waste toner containing space portion; and an open/shut mechanism having a single shutter automatically opening and shutting the supply hole and the receiving hole in response to a movement of the main body with respect to the loading portion.

* * * * *